US008763982B1

(12) United States Patent
Murrell

(10) Patent No.: US 8,763,982 B1
(45) Date of Patent: Jul. 1, 2014

(54) SINGLE WHALER-BACKED FORM SUPPORT BRACKET SYSTEM

(71) Applicant: David W Murrell, San Miguel, CA (US)

(72) Inventor: David W Murrell, San Miguel, CA (US)

( * ) Notice: Subject to any disclaimer, the term of this patent is extended or adjusted under 35 U.S.C. 154(b) by 0 days.

(21) Appl. No.: 13/691,833

(22) Filed: Dec. 2, 2012

Related U.S. Application Data

(60) Provisional application No. 61/566,551, filed on Dec. 2, 2011.

(51) Int. Cl.
*E04G 25/06* (2006.01)

(52) U.S. Cl.
CPC ..... *E04G 25/061* (2013.01); *E04G 25/06* (2013.01)
USPC ..... 249/34; 249/219.1; 248/354.5; 248/125.1

(58) Field of Classification Search
USPC ..... 249/34; 248/352, 354.4, 354.5, 354.6
See application file for complete search history.

(56) References Cited

U.S. PATENT DOCUMENTS 786,054 A * 3/1905 Roy ..... 248/244
1,381,663 A * 6/1921 Roeder ..... 248/354.5
2,258,827 A * 10/1941 Tracht ..... 254/98
2,475,548 A * 7/1949 Kearns ..... 248/353
2,939,198 A * 6/1960 Nicholls ..... 249/47
3,229,940 A * 1/1966 Kagels ..... 248/124.1
3,797,800 A * 3/1974 Loy ..... 249/13
3,807,681 A * 4/1974 Kane et al. ..... 249/29
3,915,423 A * 10/1975 Tooley ..... 249/210
4,056,254 A * 11/1977 Tooley ..... 249/210
4,479,634 A * 10/1984 Blatz ..... 254/133 R
4,589,622 A * 5/1986 Hutter ..... 248/649
4,631,878 A * 12/1986 Laramore ..... 52/90.2
4,648,516 A * 3/1987 Elkins ..... 211/64
4,690,361 A * 9/1987 Lundman ..... 248/352
4,776,471 A * 10/1988 Elkins ..... 211/64
4,778,144 A * 10/1988 Gregory ..... 249/29
5,076,535 A * 12/1991 Vetter ..... 249/219.1
5,351,926 A * 10/1994 Moses ..... 248/354.5
5,445,352 A * 8/1995 Long ..... 248/354.5
5,940,917 A 8/1999 Wilson et al.
6,158,710 A * 12/2000 Matthews ..... 249/34
6,550,213 B1 * 4/2003 Butler ..... 52/741.15
7,255,319 B2 * 8/2007 Albano ..... 249/34
7,290,697 B1 * 11/2007 Lessard ..... 232/39
8,132,774 B1 * 3/2012 Whatcott ..... 249/4

* cited by examiner

*Primary Examiner* — Michael Safavi
(74) *Attorney, Agent, or Firm* — William Keyworth; Bill & Mary Lou Inc.

(57) ABSTRACT

A form support bracket system allows building concrete forms for soffit and stem wall construction using a single whaler backed vertical stem wall form. The bracket system allows for adjustable height of the soffit, and adjustable thickness of the stem wall.

9 Claims, 6 Drawing Sheets

SINGLE WHALER-BACKED FORM SUPPORT BRACKET SYSTEM

CROSS-REFERENCE TO RELATED APPLICATIONS

This application claims the benefit of priority from Provisional Patent Application No. 61/566,551 filed on Dec. 2, 2011, which is incorporated herein by reference in its entirety.

STATEMENT REGARDING FEDERALLY SPONSORED RESEARCH AND DEVELOPMENT

Not Applicable.

BACKGROUND OF THE INVENTION

1. Field of the Invent

This invention relates to an article of manufacture, a method of use, and a method of manufacture that provides a support for a vertical concrete construction form, such as a plywood sheet. Such forms are typically used for the faces of a stem wall.

2. Description of Related Art

Construction practice in preparing forms to pour the soffit and stem wall of concrete structures, such as box girder bridges, typically use a 2×4 frame faced with a sheet form material, such as plywood, for the stem wall. This is supported on concrete dobies which become a part of the soffit. Such a form configuration is material and labor intensive in comparison with forming the vertical stem wall faces with a single whaler backed form. Use of the single whaler backed form requires a means for support that attaches to the sheet form material. The present invention provides a system to support sheet form material to allow the material and labor saving of a single whaler system.

SUMMARY OF THE INVENTION

The single whaler form support bracket system includes a form height support rod, a form bracket and attachment hardware. Multiple brackets are used to support each section of the sheet form material to provide for locating of the sheet form material lower edge at the desired height. The length of the form height support rod and the attachment location of the bracket on the sheet form material set the height of the brackets above the lower surface soffit form. The bracket attachment hardware attaches the bracket to the sheet form material in a manner fixing the location of the top of the rod support form at a predetermined distance from the sheet form material lower edge and anchors the bracket to that edge. The bracket has a form height support rod enclosure, a sheet form material outer surface contacting surface, and a sheet form material lower edge support, and a sheet form material lower edge retaining surface contacting the sheet form material outer inner surface. The attachment hardware attaches the bracket sheet form material lower edge support to the sheet form material lower edge and the form height support rod enclosure to the sheet form material. The latter attachment hardware is located so as to support the bracket and sheet form material on the top end of the form height support rod.

The method of use of the single whaler form support bracket is to determine the desired length of the form height support rod to provide the desired height of the soffit at the transition to the stem wall. This is the desired height plus the distance on the form support bracket from the sheet form material lower edge support to the upper fastener locator. The number of support brackets is also determined, and form height support rods are cut to the desired length. A support bracket is placed at a desired location on a piece of sheet form material with the sheet form material lower edge support contacting the sheet form material lower edge and the sheet form material outer surface contacting surface contacting the outer surface. A fastening device, example #4 common nail, is driven into the sheet form material, which retains the bracket on the sheet form material. A second fastening device, example #6 duplex nail, is driven through the form height support rod enclosure contacting surface into the sheet form material. One or more additional single whaler form support brackets are attached to the sheet form material. A form height support rod is then inserted into each form height support rod enclosure until it contacts the second fastening device and the sheet form material is located such that the form height support rod lower surfaces contact the soffit lower surface form. The sheet form material is further located and supported in a manner using whalers, support brackets, wall thickness spacers and strongbacks as needed in building concrete wall forms.

OBJECTS AND ADVANTAGES

The objective of the invention is to provide a bracket system to quickly and accurately locate a concrete stem wall form at a desired location to allow a desired thickness of soffit at the wall juncture with the soffit.

BRIEF DESCRIPTION OF THE SEVERAL VIEWS OF THE DRAWINGS

A more complete understanding of the present invention can be obtained by considering the detailed description in conjunction with the accompanying drawings, in which.

REFERENCE NUMERALS IN DRAWINGS

Figure 1:
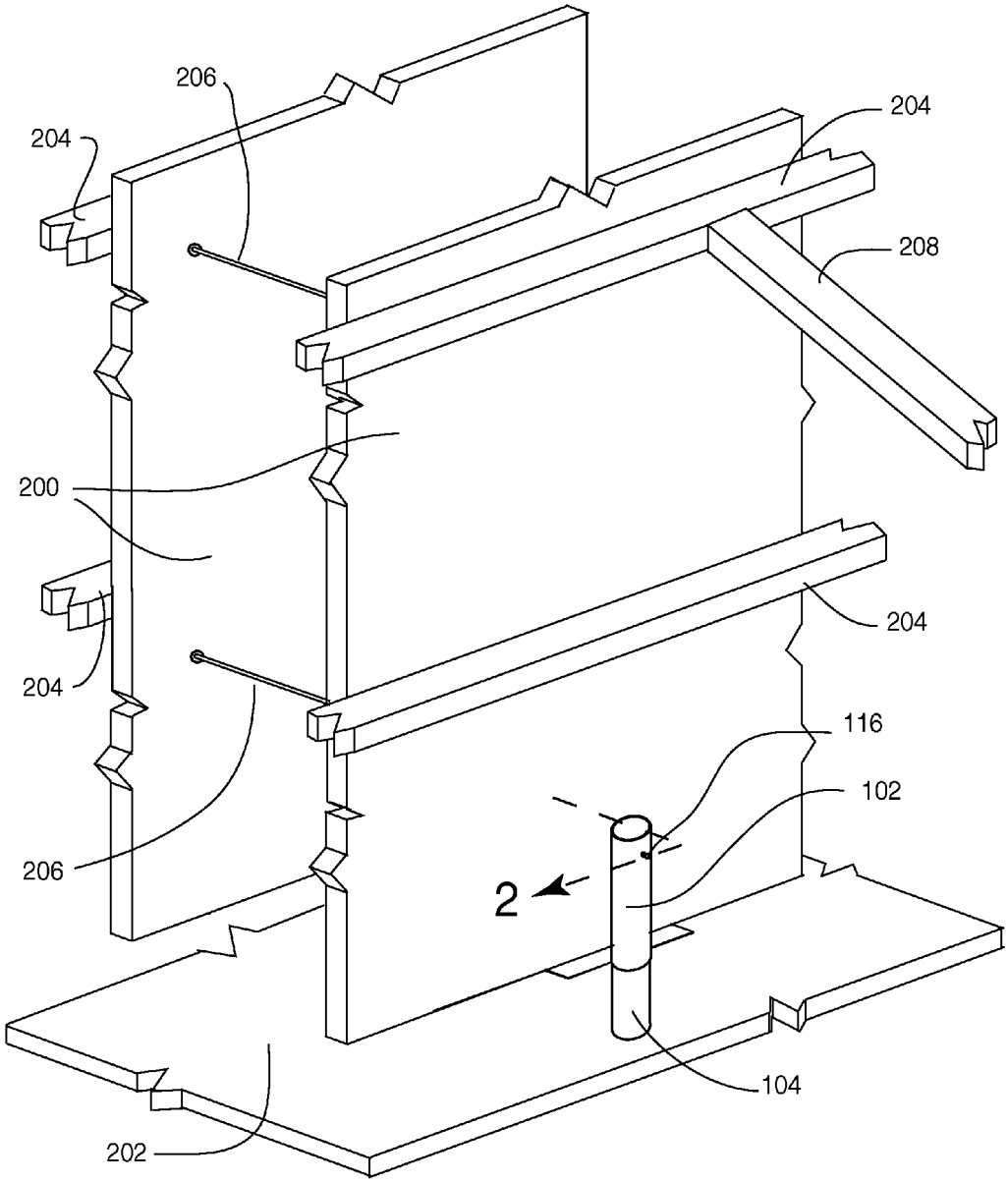
FIG. 1 is a perspective view of an example of a single whaler concrete stem wall form being assembled and employing the present invention. The location of the cross-section of FIG. 2 is shown in this figure.

These reference numbers are used in the drawings to refer to areas or features of the invention.

102 Single whaler form support bracket
104 Form height support rod
106 Form height support rod enclosure

108 Sheet form material outer surface contacting surface
110 Sheet form material
112 Sheet form material lower edge retaining surface
114 Lower fastener locator
116 Upper fastener locator
118 Fastener
200 Sheet form material
202 Soffit lower form
204 Whaler
206 Wall thickness spacer
208 Strongback

DETAILED DESCRIPTION OF THE INVENTION

FIG. 1 illustrates a section of a single whaler form support bracket system in place for a concrete pour of a soffit and a stem wall. Concrete reinforcement components are not shown. Those familiar with the art will recognize that this section is a portion of the soffit and stem wall, and may also be a portion of multiple stem walls poured on one or more soffits. Concrete reinforcements are not shown. The concrete is poured between the two sheet form materials (200), which are typically plywood sheets, and between the sheet form material lower edges and the soffit lower form (202) top surface. The sheet form material lower edges are raised above the soffit lower form (202) by support from the single whaler form support bracket (102). The distance between the soffit lower form (202) top surface and the sheet form material lower edges is controlled by the length of the form height support rod (104) which is in contact with the soffit lower form (202) top surface and supports the single whaler form support bracket (102). The form height support rod (104) is connected to the single whaler form support bracket (102) by an upper fastener locator (116), typically arranged for insertion of a #6 duplex nail. This connection is a means of maintaining the height of the sheet form material lower edge.

The sheet form material (200) is also supported by whalers (204), with strongback (208) supports, and wall thickness spacers (206) to maintain the desired stem wall thickness.

Figure 2:
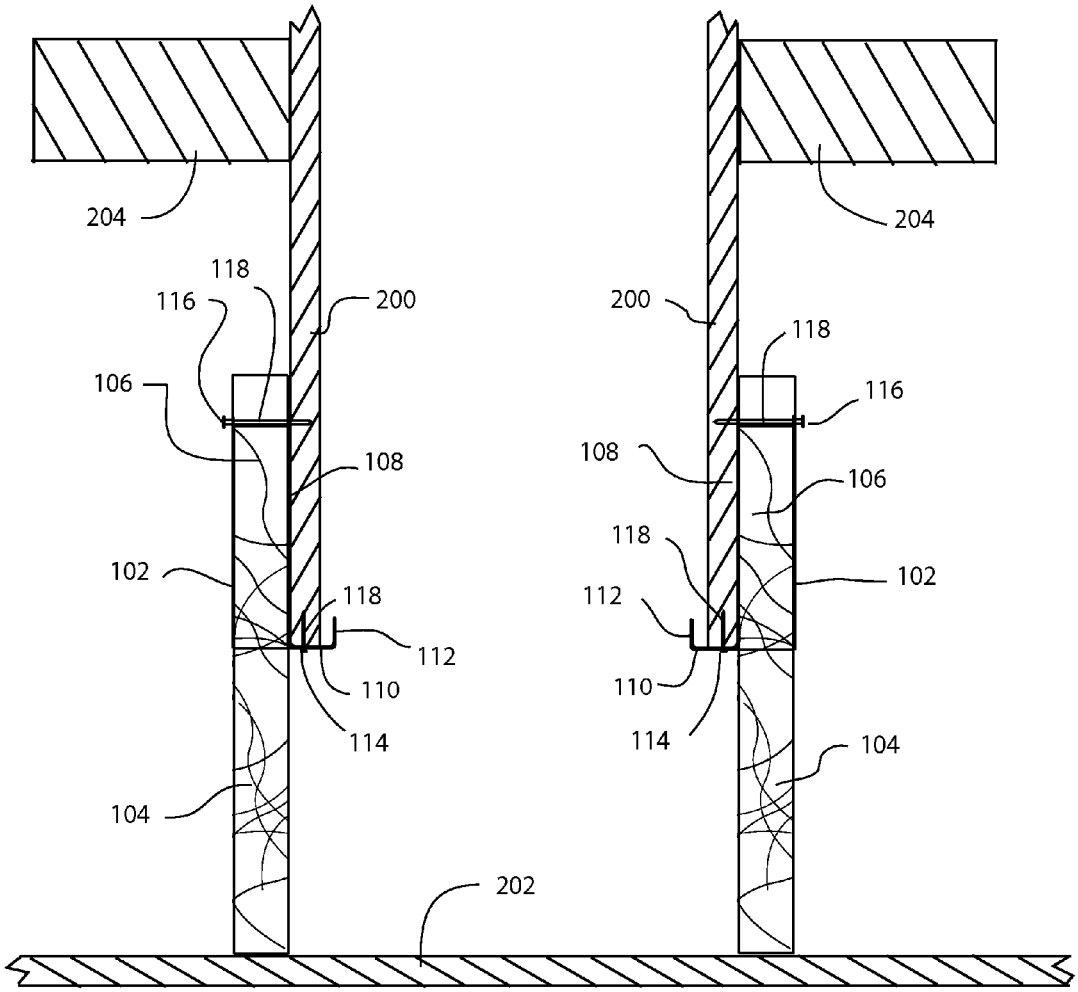
FIG. 2 is a cross-section view of the single whaler form support bracket system installed on each side of a concrete stem wall form.

FIG. 2 shows a cross-section of the single whaler form support bracket system at the location shown in FIG. 1. The sheet form material (200) lower edge is supported on the single whaler system support bracket (102) which in turn is connected to a form height support rod (104) that rests on the soffit lower form (202). The sheet form material (200) is also supported by whalers (204) and wall thickness spacers (206) to maintain the desired stem wall thickness as described previous.

The single whaler system support bracket (102) has a form height support rod enclosure (106) arranged to contain, with the inner surface of the enclosure, an upper portion of the form height support rod (104) and further arranged with an upper fastener locator (116), proximate to the upper end, arranged for insertion of a fastener (118), for example a #6 duplex nail, which fastens to the sheet form material to support the bracket on the form height support rod (104) upper end. Together with the predetermined length of the form height support rod (104) the upper fastener locator (116) determines the height of the bracket above the soffit lower form (202) top surface. The bracket (102) is arranged to support the sheet form material lower edge by a sheet form material outer surface contacting surface (108) arranged on the outer surface of the upper fastener locator (116), a sheet form material lower edge support (110) with a lower fastener locator (114), typically arranged for insertion of a fastener (118), for example a #4 common nail, and a sheet form material lower edge retaining surface (112). The upper fastener locator (116) thus provides means for maintaining a consistent height of the sheet form material lower edge when it is supported on the sheet form material lower edge support (110).

Figure 3:
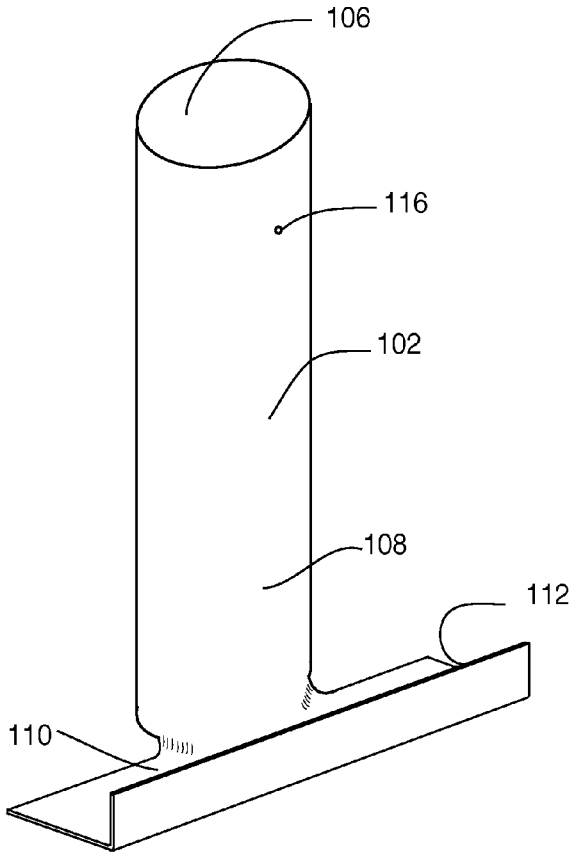
FIG. 3 is a perspective view of the single whaler form support bracket.
Figure 4:
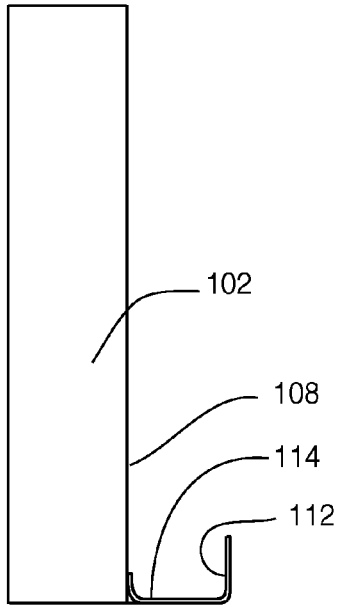
FIG. 4 is a left side view of the single whaler form support bracket. The right side view is a mirror image.
Figure 5:
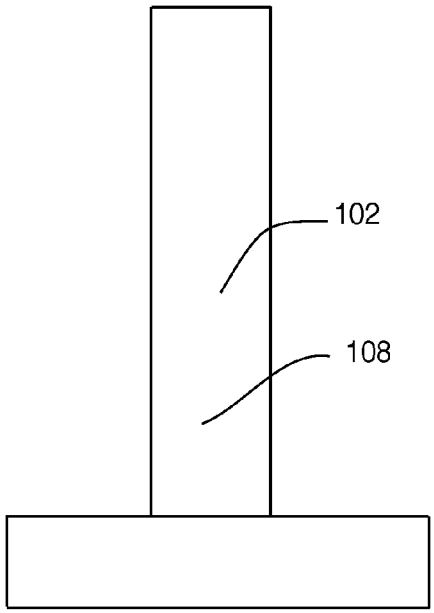
FIG. 5 is a front view of the single whaler form support bracket.
Figure 6:
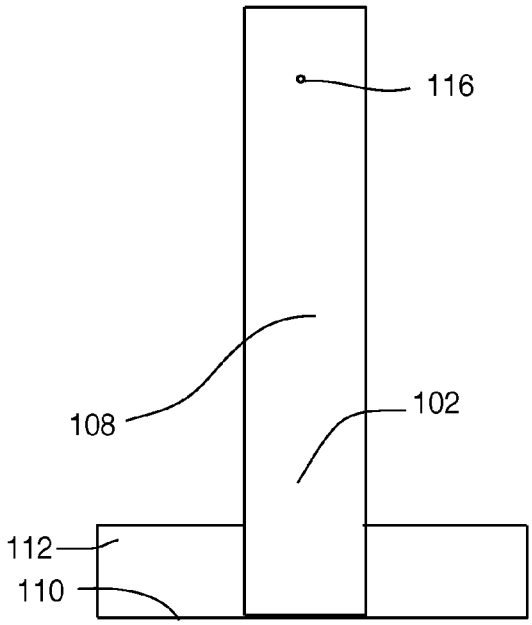
FIG. 6 is a back view of the single whaler form support bracket
Figure 7:
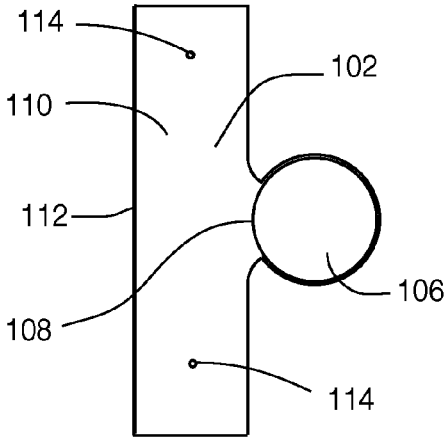
FIG. 7 is a top view of the single whaler form support bracket.
Figure 8:
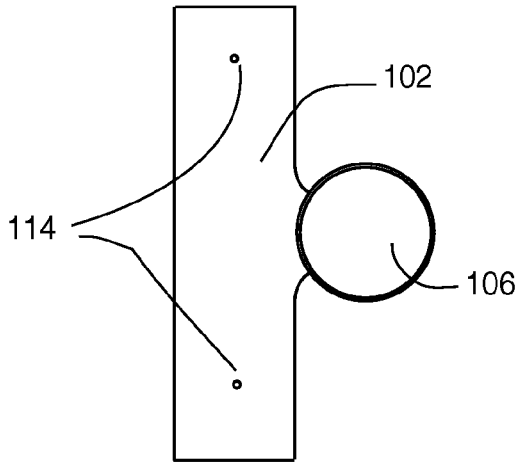
FIG. 8 is a bottom view of the single whaler form support bracket.

FIG. 3 shows a perspective view of a single whaler system support bracket (102). FIG. 4 shows a side view of the single whaler system support bracket (102). FIG. 5 shows a front view of the single whaler system support bracket (102). FIG. 6 shows a back view of the single whaler system support bracket (102). FIG. 7 shows a top view of the single whaler system support bracket (102) and FIG. 8 shows a bottom view. The bracket (102) has a form height support rod enclosure (106) with an upper fastener locator (116), a sheet form material outer surface contacting surface (108), a sheet form material lower edge support (110), with a lower fastener locator (114), a sheet form material lower edge retaining surface (112). The upper and lower fastener locators (116 and 114) are openings arranged for typical fasteners (example #6 duplex nail and #4 common nail respectively) used in concrete form construction.

Manufacture of the single whaler system support bracket (102) may be done by forming through rolling, extruding, or stamping sheet metal, or molding a suitable strength metal or polymer. The process chosen provides for forming the bracket with a form height support rod enclosure (106) with an upper fastener locator (116), a sheet form material outer surface contacting surface (108), a sheet form material lower edge support (110) with a lower fastener locator (114), and a sheet form material lower edge retaining surface (112).

Operation

Figure 9:
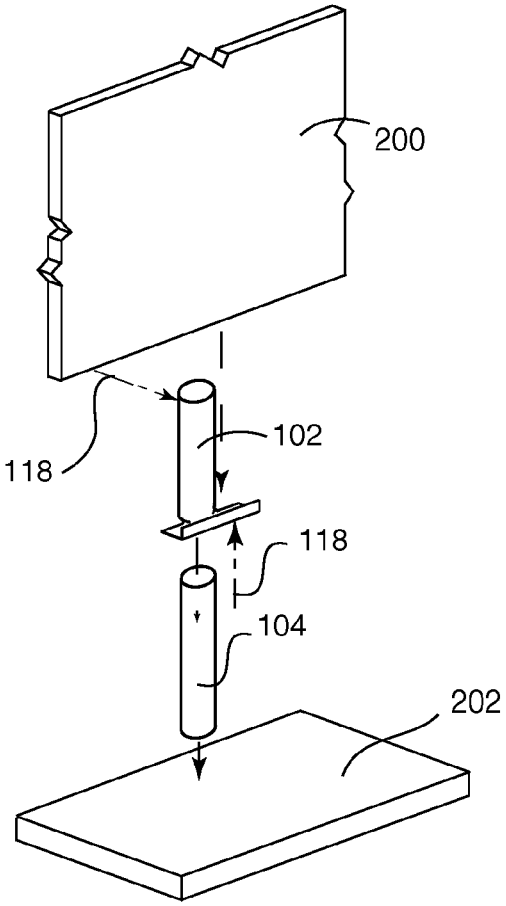
FIG. 9 is an exploded view of the single whaler form support bracket system showing the relationship of the components.

FIG. 9 shows an exploded view of the single whaler form support bracket system showing the arrangement of parts of the system, including the fasteners (118). The system support bracket (102) and support rod (104) supports sheet form material (200) by its lower edge at a desired location above the top surface of a soffit lower form (202). This allows pouring a soffit and stem wall in one concrete pour.

Once the desired length of the form height support rod (104) to provide the desired height of the soffit at the transition to the stem wall is determined, the number of support brackets must also be determined so that sufficient form height support rods (104) can be cut to the desired length.

To assemble the form, a form support bracket (102) is placed at a desired location on a piece of sheet form material (200) lower edge with the sheet form material lower edge support (110) contacting the sheet form material (200) lower edge and the sheet form material outer surface contacting surface (108) contacting the outer surface. This places the form support bracket lower edge retaining surface (112) in contact with the sheet material inner surface. A fastening device (118), example #4 common nail, is driven through the lower fastener locator (114) on the bracket into the sheet form material (200), which retains the bracket on the sheet form material. A second fastening device (118), example #6 duplex nail, is driven through the form height support rod enclosure (106) and into the sheet form material (200). This further aids in retaining the sheet form material (200) to the support bracket (102). A form height support rod (104) is selected and the top of the rod (104) is inserted into the bracket form height support rod enclosure (106) sufficiently for its upper end to contact the second fastening device, which provides the desired height of the sheet form material (200) lower edge from the bottom of the form height support rod (104).

One or more additional single whaler form support brackets are attached to the sheet form material. A form height support rod is then inserted into each form height support rod enclosure until it contacts the second fastening device and the sheet form material is located such that the form height support rod lower end contacts the soffit lower surface form. The sheet form material is further located and supported in a manner using whalers, support brackets, wall thickness spacers and strongbacks as needed in building concrete wall forms.

Those familiar with the art will recognize that the preferred and other embodiments described have other possible variations. The descriptions of the invention provided are not intended to limit the invention.

I claim:

1. A concrete soffit and stem wall construction single whaler backed sheet form material system comprising:

a. one or more form height support rods with an upper end, and a lower end, b. one or more form support brackets arranged with a form height support rod enclosure with an inner surface arranged to contain an upper portion of one form height support rod and an outer surface, one or more upper fastener locator arranged through the form height support rod enclosure inner and outer surfaces, a sheet form material lower edge support arranged to contact a lower edge of a sheet form material and further arranged with a sheet form material lower edge retaining surface arranged to contact an inner surface of the sheet form material, and one or more lower fastener locator arranged through the sheet form material lower edge support; and c. one or more upper and lower fasteners arranged within the upper and lower fastener locators, the upper fasteners arranged to attach to the sheet form material and support the form bracket on the upper end of the height support rod, the lower fasteners arranged to attach to the sheet form material lower edge whereby the attached sheet form material lower edge is supported by the form support bracket lower edge support with the inner surface contacting the form support bracket lower edge retaining surface and the outer surface contacting the form support bracket outer surface contacting surface.

2. The concrete soffit and stem wall construction form system of claim 1 further comprising one or more whaler engaged with the sheet form material and supported by a strongback.

3. The concrete soffit and stem wall construction form system of claim 2 further comprising a soffit lower form arranged to support the height support rod lower end.

4. The concrete soffit and stem wall construction form of claim 3 further comprising one or more wall thickness spacers arranged between two or more opposing sheet form materials supported on two or more form support brackets.

5. A method of manufacturing the system of claim 1 comprising:

a. selecting a form height support rod with a desired distance between an upper end and a lower end;

b. placing a form support bracket at a desired location on a piece of sheet form material lower edge arranged so the form support bracket lower edge support is contacting the sheet form material lower edge and the form support bracket outer surface contacting surface is contacting the sheet form material outer surface and the form support bracket lower edge retaining surface is contacting the sheet form material inner surface;

c. fastening a fastener through one or more form support bracket lower fastener locators thereby attaching the fastener to the sheet form material;

d. fastening a fastener through one or more form support bracket upper fastener locators thereby attaching the fastener to the sheet form material;

e. repeating steps a. through d. for the desired number of form support brackets on the sheet form material lower edge f. placing the form support rod upper end into each form support bracket support rod enclosure whereby the support rod engages the fastener in the form support bracket upper fastener locator; and g. supporting the sheet form material form support brackets on the form support rod lower ends.

6. The method of claim 5 further comprising locating the sheet form material with a combination of whalers and strongbacks.

7. The method of claim 6 further comprising providing a soffit lower form arranged to provide the support of the height support rod lower end.

8. The method of claim 7 further comprising providing one or more wall thickness spacers arranged between two or more opposing sheet form materials supported on two or more form support brackets.

9. A concrete soffit and stem wall construction form sheet form material support bracket arranged to be supported on a form height support rod with an upper end and a lower end comprising:

a. a form height support rod enclosure with an inner surface arranged to contain a portion of one form height support rod adjacent the upper end and an outer surface arranged to provide a sheet form material outer surface contacting surface, the enclosure with an open top end and an open bottom end;

b. one or more upper fastener locator arranged through the form height support rod enclosure inner and outer surfaces proximate to the top end; and c. a sheet form material lower edge support connected to the support rod enclosure at the bottom end and arranged to position a lower edge of a sheet form material and further arranged with a sheet form material lower edge retaining surface and one or more lower fastener locator arranged through the sheet form material lower edge support whereby a sheet form material may be supported on the bracket lower edge support, retained on the support by the lower edge retaining surface, and attached to the bracket by fasteners in the upper fastener locator and the lower fastener locator.

* * * * *